US005814126A

United States Patent [19]

Cook

[11] Patent Number: 5,814,126

[45] Date of Patent: Sep. 29, 1998

[54] METHOD AND APPARATUS FOR PRODUCING BRIGHT AND SMOOTH GALVANIZED COATINGS

[76] Inventor: Thomas H. Cook, 430 E. Dakota St., Spearfish, S. Dak. 57783

[21] Appl. No.: 949,331

[22] Filed: Oct. 14, 1997

Related U.S. Application Data

[63] Continuation of Ser. No. 493,498, Jun. 22, 1995, abandoned, which is a continuation-in-part of Ser. No. 180,414, Jan. 12, 1994, abandoned.

[51] Int. Cl.[6] ..... C22B 19/00

[52] U.S. Cl. ..... 75/663; 266/135; 266/217

[58] Field of Search ..... 266/216, 217, 266/135, 44; 75/663; 148/240; 134/1, 2, 24

[56] References Cited

U.S. PATENT DOCUMENTS

| | | | |
|---|---|---|---|
| 1,901,464 | 3/1933 | Moritz . | |
| 2,311,881 | 3/1943 | Smith | 117/114 |
| 3,632,411 | 1/1972 | Stark | 117/114 A |
| 3,707,400 | 12/1972 | Harvey et al. | 117/102 L |
| 3,723,160 | 3/1973 | Tanaka et al. | 117/50 |
| 3,741,751 | 6/1973 | Bone | 75/65 |
| 3,743,263 | 7/1973 | Szekely | 266/34 A |
| 3,753,690 | 8/1973 | Emley et al. | 75/68 R |
| 3,813,260 | 5/1974 | Lipstein | 117/114 R |
| 3,972,709 | 8/1976 | Chia et al. | 75/93 R |
| 4,047,938 | 9/1977 | Szekely | 75/67 A |
| 4,053,663 | 10/1977 | Caldwell et al. | 427/320 |
| 4,310,572 | 1/1982 | Stavros | 427/349 |
| 4,435,211 | 3/1984 | Schwartz et al. | 75/62 |
| 4,456,663 | 6/1984 | Leonard | 428/653 |
| 4,717,540 | 1/1988 | McRae et al. | 420/513 |
| 4,743,428 | 5/1988 | McRae et al. | 420/590 |
| 5,084,094 | 1/1992 | Francois et al. | 75/663 |

*Primary Examiner*—Scott Kastler

*Attorney, Agent, or Firm*—Roylance, Abrams, Berdo & Goodman, L.L.P.

[57] ABSTRACT

A method for cleaning and treating the walls of a kettle containing a molten metal such as zinc comprises injecting nitrogen or other gas into the molten metal through a reaction container. The reaction container may contain a second metal capable of forming an alloy with the molten metal. The reaction container is immersed in the molten metal adjacent the sidewall of the kettle and is moved around the peripheral edge of the kettle to disperse the second metal and the nitrogen into molten metal. The reaction container includes a gas feed pipe having a lower end with a plurality of gas outlets. An enclosure for containing the second metal surrounds the lower end of the feed pipe such that gas exiting the feed pipe bubbles upwardly through the enclosure to contact the second metal. In a preferred embodiment, the gas is nitrogen and the second metal is aluminum which form aluminum nitride in the molten metal.

17 Claims, 3 Drawing Sheets

FIG. 3
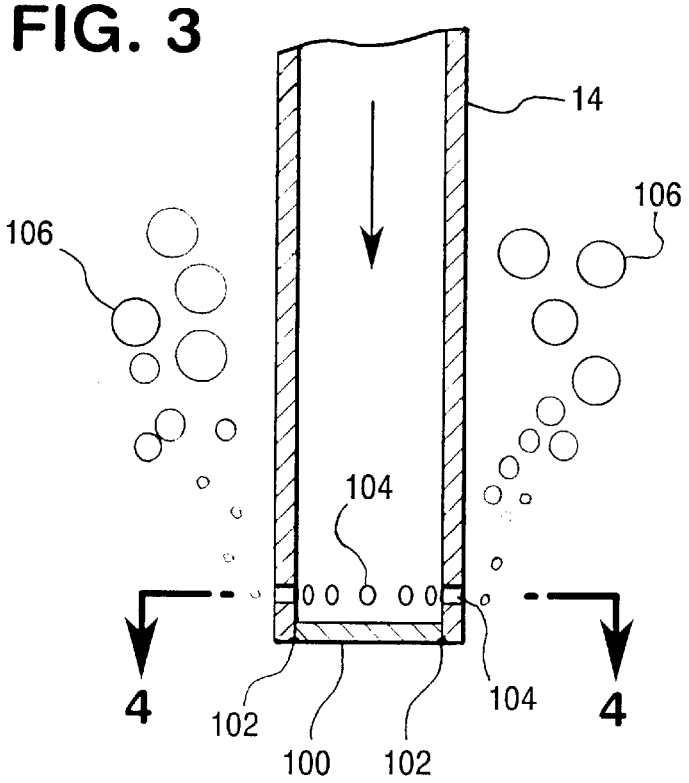
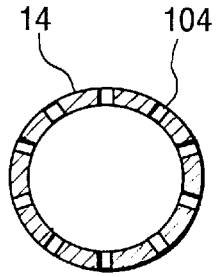
FIG. 4
FIG. 5
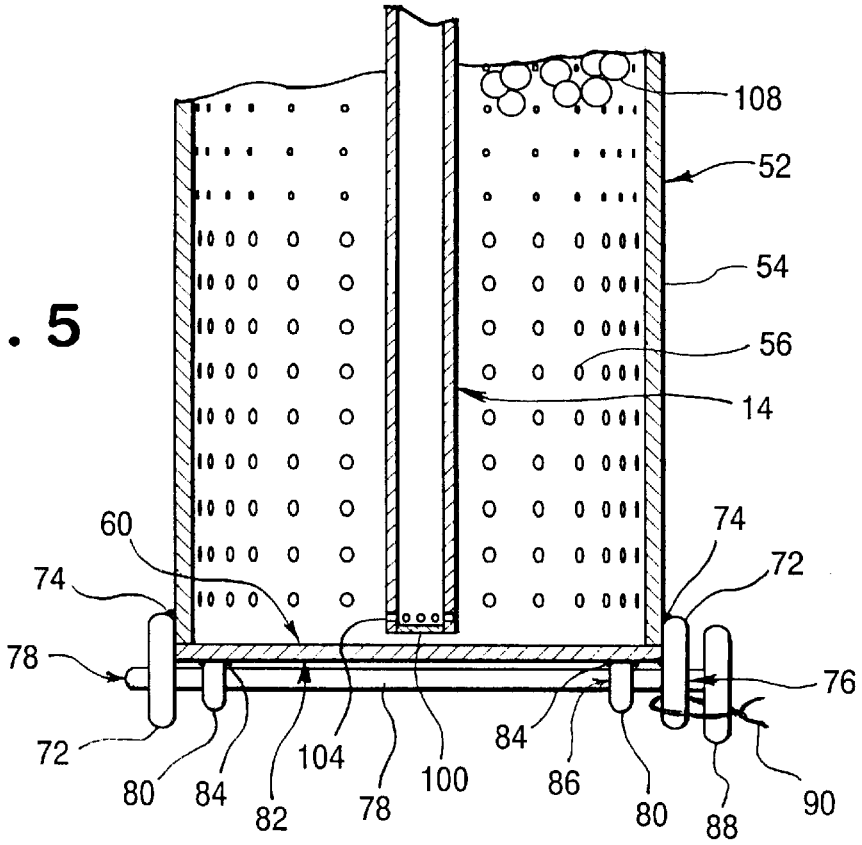

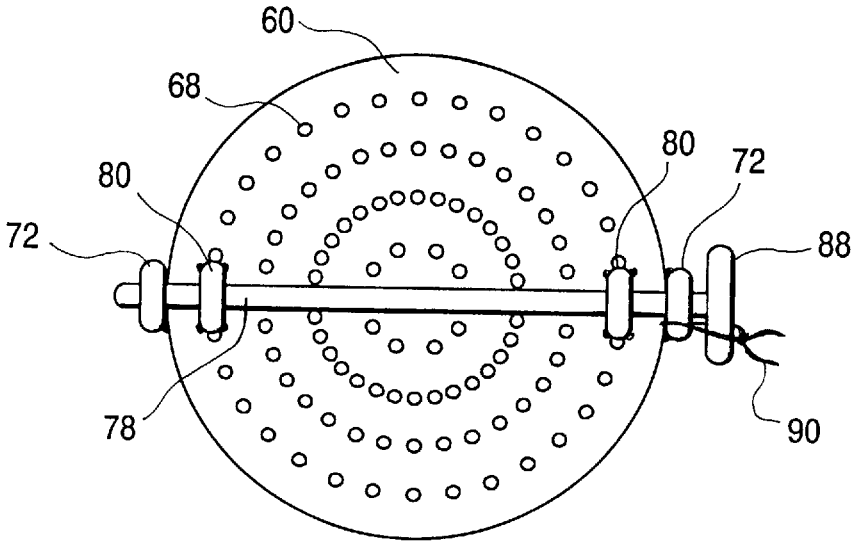
FIG. 6
FIG. 7
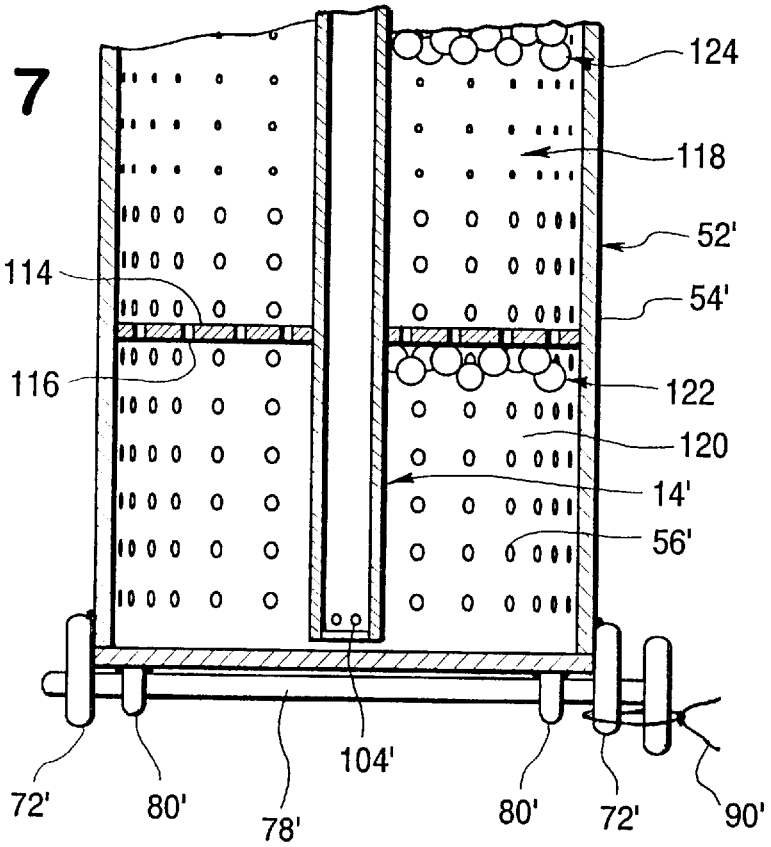

METHOD AND APPARATUS FOR PRODUCING BRIGHT AND SMOOTH GALVANIZED COATINGS

CROSS-REFERENCE TO RELATED APPLICATION

This is a continuation of application Ser. No. 08/493,498 filed Jun. 22, 1995, now abandoned, which is a continuation-in-part application of application Ser. No. 08/180,414, filed Jan. 12, 1994, now abandoned.

FIELD OF THE INVENTION

The present invention is directed to a method and apparatus for treating molten metal and in particular molten zinc for producing a bright and smooth galvanized finish on a metal substrate. More particularly, the invention is directed to a method and apparatus for cleaning scale from the walls of a galvanizing kettle reducing the formation of ash and dross and treating the molten zinc to produce the bright and smooth finish.

BACKGROUND OF THE INVENTION

Galvanizing processes have been used for many years for producing a zinc coating on iron or steel to prevent corrosion. One common method of galvanizing is to provide a molten bath of zinc and dipping the article to be coated in the molten zinc. Prior to dipping in the molten zinc, the article must be cleaned to remove oxides and other impurities to ensure a complete and uniform coating. The oxides are typically removed by pickling in sulfuric or hydrochloric acid or by blasting with an abrasive, rinsing in water and applying a flux. The quality of the zinc coating is dependent on numerous factors including the temperature of the molten metal, the composition of the zinc and the proper preparation of the article being coated. The resulting zinc coating produced by many conventional processes is usually dull and has a pimpled surface. The coating may further develop a while chalky coating on exposure to moisture and is referred to as white rust.

Numerous methods have been proposed for improving the quality of zinc coatings and making the processes more economical to operate. Examples of such processes can be found in U.S. Pat. Nos. 3,753,690 to Emley et al. and 4,435,211 to Schwartz et al.

One process for improving the quality of the zinc coating is to add aluminum to the zinc to form a zinc-aluminum alloy. Rather than using pure aluminum, 10% aluminum-90% zinc alloy bars are commonly added to the molten zinc to attain the final desired aluminum content. High aluminum concentrations due to inadequate mixing cause excess dry ash skimmings on the surface of the molten zinc. The skimmings contain primarily zinc oxides which result in a significant loss of usable zinc. In addition, the zinc oxides formed on the surface of the molten metal contain large amounts of the aluminum such that the aluminum content of the alloy can be easily depleted. As much as 95% of the aluminum can be lost in the skimmings. Aluminum can also react with the chlorides in the flux to further deplete the aluminum content. The constant deletion of aluminum produces inconsistent results in the coating. These methods of adding aluminum to the molten zinc often result in a very heterogenous aluminum-zinc mixture which produces a non-uniform coating. This method of adding aluminum to the molten zinc also produces localized high aluminum concentrations on the galvanized steel workpiece resulting in white rust. Aluminum concentrations of 0.005% are known to produce white rust on the galvanized workpiece in some processes.

Other galvanizing methods use a coating of an alloy of aluminum and zinc containing 25–70% aluminum. The coating is usually a multi-phase coating having zinc rich and aluminum rich regions in the coating overlay. These coatings are known to have high corrosion resistance but typically result in high aluminum consumption. Examples of methods of adding aluminum to molten zinc are disclosed in U.S. Pat. Nos. 4,717,540 to McRae et al. and 4,743,428 to McRae et al.

Another process of galvanizing metal includes bubbling nitrogen gas through the molten zinc. The nitrogen is introduced to the molten metal using a plurality of vertical pipes immersed into the molten zinc and attached to a horizontal manifold which is in turn connected to a plurality of compressed nitrogen tanks. Efforts to reproduce and duplicate this type of galvanizing process produced large quantities of dry ash on the surface of the molten zinc and did not produce a good quality galvanizing finish. In addition, bubbling nitrogen through the zinc was found to completely remove the alloyed aluminum.

Another method of purifying molten zinc includes submerging a vegetable material such as green wood or a raw potato into the molten zinc and skimming off the impurities floating on the surface of the zinc. Scientific proof of the effectiveness of such methods are not available in the literature.

The previous methods of producing a galvanizing finish on a workpiece do not consistently produce good quality zinc coatings The resulting coatings are usually dull and non-uniform. Furthermore, the galvanizing processes result in high losses of zinc and aluminum due to the ash formation on the surface of the molten zinc and the build-up of scale around the walls of the kettle. The floating ash and the scale on the walls of the kettle must be removed before the zinc coating can be applied. These steps result in increased labor and operating expenses as well as loss of zinc available for galvanizing. Efforts to prevent the formation of scale on the wall of the kettle and the formation of dry ash on the surface of the zinc have not been entirely successful.

Examples of process for treating liquid metal and producing galvanized coatings are disclosed in U.S. Pat. Nos. 3,743,263 to Szekely, 3,972,709 to Chia et al., and 4,310,572 to Stavros.

SUMMARY OF THE INVENTION

Accordingly, a primary object of the invention is to provide a method and apparatus for producing high quality galvanized coatings.

Another object of the invention is to provide a method and apparatus for producing a galvanized coating that is substantially free of white rust and black spots.

A further object of the invention is to provide a method and apparatus for galvanizing metal that is easy to operate and produces consistent high quality coatings with reduced losses of available zinc.

Another object of the invention is to provide a method and apparatus for galvanizing metal with minimal formation of dry ash on the surface of the molten metal and scale build-up on the walls of the galvanizing kettle.

A further object of the invention is to provide a method and apparatus for cleaning and removing the scale build-up on the walls of a galvanizing kettle while reducing formation of ash on the surface of the molten metal.

Another object of the invention is to provide a method and apparatus for galvanizing metal by the addition of aluminum and nitrogen to the molten metal with reduced losses and consumption of the aluminum and nitrogen.

The foregoing objects are basically attained by providing a device for injecting a gas in the form of discrete bubbles into a bath of molten metal comprising a reaction container means for immersing into a bath of molten metal, the reaction container means including an upper wall, sidewall and bottom wall, and means defining a gas outlet for forming said discrete bubbles; and means for supporting the container means in a fixed angular position and for introducing the gas into the reaction container means, the supporting means being an annular pipe having an outlet within said container means.

The foregoing objects of the invention are further attained by providing a method of cleaning and removing scale from a sidewall of a galvanizing kettle containing molten zinc comprising immersing a gas injector into the molten zinc; injecting nitrogen into the molten zinc through the injector below the surface thereof and bubbling nitrogen through the molten zinc adjacent the sidewall of the kettle to remove scale from the sidewall and reduce the formation of ash.

The objects of the invention are further attained by providing a method of producing a bright, smooth and reflective zinc coating on a metal substrate comprising the steps of: providing a molten zinc in a vessel; simultaneously introducing metallic aluminum and nitrogen gas to the molten zinc wherein at least a portion of the nitrogen contacts the aluminum while being introduced to form aluminum nitride, with the remainder of the nitrogen being bubbled through the molten zinc, and immersing a metal substrate in the molten zinc to form a bright zinc coating.

Other objects, advantages and salient features of the invention will become apparent from the following detailed description, which, taken in conjunction with the annexed drawings, discloses the preferred embodiments of the invention.

BRIEF DESCRIPTION OF THE DRAWINGS

Referring to the drawings which form a part of this original disclosure:

FIG. 3 is a cross-sectional view of the distal end of the gas feed pipe forming the gas injector;

FIG. 4 is a cross-sectional view of the gas injector of the embodiment of FIG. 3 taken along lines 4—4 of FIG. 3;

FIG. 5 is a cross-sectional view of the gas injector of the embodiment of FIGS. 1 and 2;

FIG. 6 is an end view of the gas injector as seen from the bottom of FIG. 5; and FIG. 7 is a cross-sectional view of an alternative embodiment of the invention showing a perforated plate in the gas injector to define two separate chambers.

DETAILED DESCRIPTION OF THE INVENTION

Figures 1, 2:
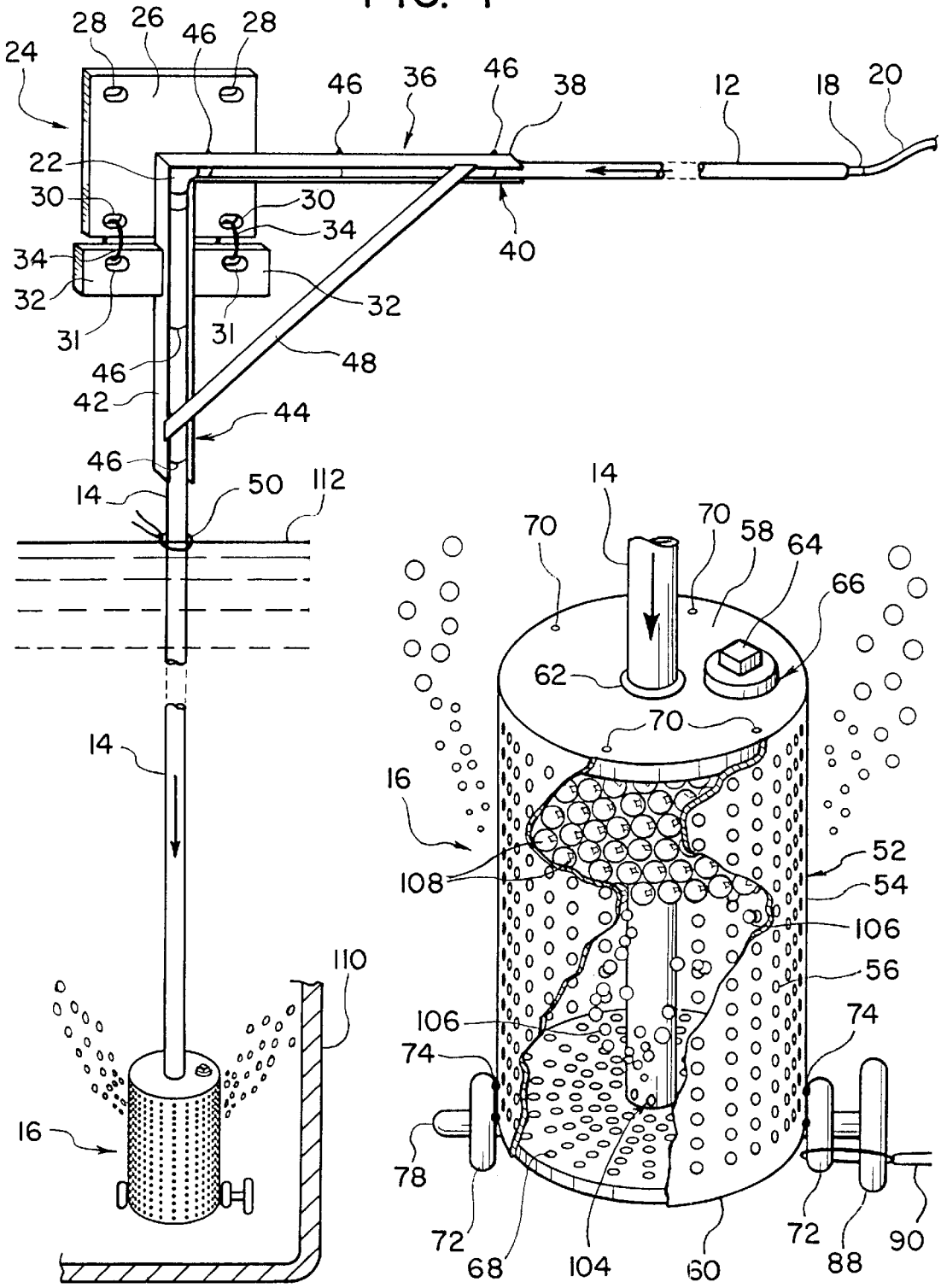
FIG. 1 is a perspective view of the device for dispersing the gas into the molten metal showing the support structure, the gas feed pipe and the gas injector.
FIG. 2 is a partial cut-away view of the gas injector device showing the solid alloying metal contained within the injector device.

The present invention is directed to a method and apparatus for dispersing an alloying metal such as aluminum and a gas into a molten metal bath. In particular, the invention is directed to a method and apparatus for introducing aluminum and nitrogen simultaneously into a molten zinc bath for producing a high quality homogenous galvanized coating. In a preferred form of the invention, the aluminum and nitrogen are initially introduced to the molten zinc to clean the walls of the galvanizing kettle to remove the scale which typically forms around the upper edge of the kettle. The method and device according to a preferred embodiment of the invention introduce aluminum and nitrogen into the molten zinc bath in a manner to reduce the amount of dry ash formed on the surface of the molten zinc, prevent dross from being stirred from the bottom of the kettle, and to reduce the amount of aluminum typically lost in the dry ash skimmings. The method and apparatus provide a means to treat the molten zinc in a manner to form a high quality zinc coating on a steel or iron substrate. The aluminum and the nitrogen are introduced into the molten zinc simultaneously such that a portion of the nitrogen reacts with a portion of the aluminum to form aluminum nitride which is then dispersed in the molten zinc. The remaining portion of the aluminum is dispersed into the zinc to form an alloy while the remaining unreacted nitrogen bubbles through the molten zinc to remove impurities. The nitrogen is bubbled through the zinc in amounts such that the aluminum is in a molar excess. Limiting the amount of nitrogen reduces the formation of ash on the surface of the zinc which reduces the amount of aluminum lost in the ash. The amount of aluminum added is controlled to increase the fluidity of the resulting zinc-aluminum alloy to provide a more uniform zinc coating.

The method and apparatus of the invention are particularly directed to improving the quality of the resulting zinc coating. As used herein, reference to a high quality coating is a zinc coating that is smooth, very bright, reflective and uniform resembling an electroplating process. The resulting coated workpieces require little or no clean-up unlike many conventional processes which require grinding, filing or sanding to remove drips and other imperfections. The zinc coatings are essentially free of black spots of bare, ungalvanized areas and after exposure to the weather are less likely to white rust.

Although the invention is primarily directed to a galvanizing process, it is to be understood that the process can be used to treat molten metals other than zinc. In addition, alloying metals other than aluminum or in combination with aluminum can be added to the molten metal. Examples of other suitable alloying metals include nickel, antimony, tin, lead and combinations thereof. Similarly, the preferred gas is nitrogen although other gases may also be used in the alternative or in combination therewith. Other gases include, for example, argon, carbon dioxide, carbon monoxide, hydrocarbons, halogenated hydrocarbons, chlorine and fluorine.

In one embodiment, the aluminum is added in an amount to attain an alloy having an aluminum concentration of about 0.001 wt % or more based on the total weight of the zinc. In further embodiments, the zinc alloy can have as little as 0.0001 wt % aluminum based on the total weight of the zinc and still produce a desirable coating. As discussed hereinafter in greater detail, nitrogen is added in an amount such that the aluminum is in a molar excess of the nitrogen. A portion of the nitrogen is reacted with the aluminum to produce aluminum nitride. The aluminum nitride and the unreacted aluminum and nitrogen are dispersed in the molten zinc. The unreacted nitrogen escapes to the atmosphere. The resulting zinc alloy is able to produce a high quality, uniform zinc coating on the steel workpiece. The amount of aluminum added is increased or decreased depending on the desired galvanizing coating. The aluminum content comprising both elemental and aluminum nitride in the zinc generally affects the fluidity of the zinc and the quality of the coating. Zinc coatings containing 0 0025 wt % or less aluminum can produce brilliant reflective coatings. The resulting coating is thinner than that obtained with smaller amounts of aluminum and may exhibit white rust and increased formation of ash and dross. Generally, the aluminum content of the zinc will range from about 0.0001 wt % to 0.25 wt %. In embodiments of the invention, the zinc contains about 0.0001 wt % to 0.005 wt % aluminum based on the weight of the zinc and preferably about 0.0001 wt % to about 0.0025 wt %. The amount of aluminum is based on the measurable aluminum according to standard techniques.

The aluminum content of molten zinc is found to have noticeable effects on the resulting zinc coatings. For example, an aluminum content above about 0.005 wt % can cause the dry ash to adhere to the zinc coatings, result in unacceptably thin coatings, and produce excess dross. An aluminum content above about 0.0025 wt % can cause white rust, depending on the climate, season, rainfall, or impurity level in the quenching water. An aluminum content above about 0.005 wt % or a lead content in the range of 0.85 wt % to 0.1 wt % can cause small diameter black spots on some steel products. Pimples on zinc coatings are typically associated with low lead contents or too shallow a kettle.

Referring to FIGS. 1–6, the device in accordance with a preferred embodiment of the invention comprises a gas supply pipe 12, a support structure 24, a gas feed pipe 14 and a reaction container and gas injector 16 fixed to the lower end of the gas feed pipe 14. The components of the device are preferably made of metal, although other heat resistant materials such as graphite or ceramic may be used.

The gas supply pipe 12 is a rigid annular pipe capable of delivering the necessary volume of gas. In preferred embodiments, the supply pipe 12 is a ¾ inch diameter steel pipe. One end of the supply pipe 12 is connected to a flow regulator, a hose coupling member 18 for connecting the supply pipe 12 to a flexible gas supply hose 20. The flexible gas supply hose 20 is connected to a gas source (not shown). Preferably, the hose coupling member 18 is a quick release type coupling for connecting the supply pipe 12 to the flexible supply hose 20. The opposite end of the supply pipe 12 is coupled to a 90° elbow coupling 22. The feed pipe 14 is similar to the supply pipe 12 in construction and dimension. An upper end of supply pipe 14 is connected to the 90° elbow 22 to provide fluid connection between the supply pipe 12 and the feed pipe 14.

As shown in FIGS. 3 and 5, the feed pipe 14 has a steel plug 100 welded to the lower end thereof at 102. Proximate to the lower end of the supply pipe 14 and the plug 100 are a plurality of holes 104 defining a plurality of gas outlets from the feed pipe 14. As shown in FIG. 4, the holes 104 are uniformly spaced around the peripheral edge of the feed pipe 14. In preferred embodiments, the holes 104 are about 1/16 inch in diameter.

The support structure 24 comprises a lifting plate 26 having a pair of holes 28 for attachment to a hoist mechanism. The hoist mechanism is typically a crane associated with the galvanizing facility. The lower end of the lifting plate 26 also includes a pair of holes 30 for attachment to holes 31 in counterweights 32. The counterweights 32 are attached to the lifting plate 26 by a suitable coupling mechanism 34 such as, for example, hooks, cables or links of chain. The counterweights 32 provide ballast for the assembly to keep the gas injector 16 submerged in the molten metal as discussed hereinafter in greater detail. The lifting plate is preferably a one ft square ¼ inch thick steel plate.

A coupling assembly 36 is fixed to the lifting plate 26 to attach the supply pipe 12 and feed pipe 14 to the support structure 24. The coupling assembly 36 comprises a horizontal steel member 38 having a downwardly facing substantially U-shaped channel 40. A vertical steel member 42 also having a substantially U-shaped channel 44 is welded at a right angle to one end of the horizontal support 38. Vertical steel member 42 is preferably welded to the lifting plate 24 although other attachment means may be used. In preferred embodiments, the support assembly 36 is fixed to support structure 24 such that the vertical steel member 42 is oriented vertically with respect to the axis of the kettle and the horizontal steel member 38 extends substantially perpendicular to the support structure 24. The U-shaped channels of support members 38 and 42 are dimensioned to receive the supply pipe 12 and feed pipe 14 as shown in FIG. 1. Supply pipe 12 and feed pipe 16 are coupled to the support member 38 and 42 by a plurality of U-bolts 46 positioned along the horizontal member 38 and vertical member 42. Preferably, six U-bolts are used to secure the feed pipe 14 and supply pipe 12 to the support structure 24. A diagonal cross brace 48 preferably extends from the vertical support 42 to the horizontal support 38.

In preferred embodiments, the feed pipe 14 includes a depth indicator 50 to position the lower end of feed pipe 14 and injector 16 a predetermined distance below the surface of the molten metal and above the bottom of the kettle. The depth indicator may be a graduated scale printed on feed pipe 14 or a removable ring shaped member made of wire as shown in FIG. 1. The depth indicator 50 is generally positioned such that the lower end of feed pipe 14 is about one foot above the dross in the bottom of the kettle when the indicator is at the surface of the molten metal.

Gas injector 16 comprises a reaction container 52 to the lower end of feed pipe 14 as shown in FIG. 2. In preferred embodiments, reaction container 52 preferably has a can-like structure having an annular outer wall 54. Outer wall 54 includes a plurality of holes 56 spaced around the perimeter of the reaction container 52. In the embodiment shown in FIG. 2, the outer wall 54 includes spaced-apart holes extending the longitudinal length and around the periphery of the reaction container 52. A top wall 58 and a bottom wall 60 are coupled to the sidewall 52 to define the enclosure of reaction container 52. In preferred embodiments, holes 56 in sidewall 54 are about 1/16 inch in diameter spaced apart on ½ inch centers.

Top wall 58 is preferably a steel plate attached to sidewall 54 by welding or other suitable means. Feed pipe 14 extends through the center of top wall 58 as shown in FIG. 2. Preferably feed pipe 14 is welded to top wall 58 at 62. In embodiments of the invention, top wall 58 includes a removable closure 64 to allow access to the reaction container 52. In the embodiment shown in FIG. 2, closure 64 is a plug member which is threaded into a complementing opening 66 in top wall 58. Closure 64 is preferably dimensioned to allow a granular metal to be placed in the reaction container 54 as discussed hereinafter in greater detail. Top wall 58 of reaction container 52 is preferably constructed of ⅜ inch steel to prevent warping. Top wall 58 may further include a plurality of holes 70 to allow gases to vent from reaction container 52 and prevent large bubbles from forming under the top wall 58. In the embodiment shown in FIG. 2, four holes 70 are provided in top wall 58 and are spaced 90° apart along the peripheral edge of the top wall 58.

Bottom wall 60 in the embodiment of FIG. 2 is removably coupled to sidewall 52. Bottom wall 60 in preferred embodiments is constructed from ¼ inch thick steel to prevent warping from the heat in the galvanizing kettle. A plurality of holes 68 are also provided in bottom wall 60. Typically, holes 68 are ⅛ inch in diameter positioned on ½ inch centers and positioned radially about ½ inch apart. Holes 68 are dimensioned to allow the molten zinc to enter and exit the reaction container 52 during the metal treatment process.

Bottom wall 60 may be removably coupled to sidewall 54 by any suitable means. In preferred embodiments as shown in FIGS. 5 and 6, a pair of brackets 72 are attached to the outer face of sidewall 54 on opposite sides thereof. Brackets 72 are attached by welding at 74. Alternatively, the brackets 72 may be attached by screws or other suitable means. As shown in FIG. 5, each bracket 72 includes a hole 76 for receiving a locking pin 78. Removable bottom wall 60 also includes a pair of brackets 80 coupled to the outer face 82 along opposite edges thereof by welds 84. Each bracket 80 includes a hole 86 for receiving pin 78 as shown in FIG. 5. Bottom wall 60 is coupled to the reaction container 52 by positioning the bottom wall 60 at the axial end of sidewall 54 such that the holes 76 in brackets 72 align with the holes 86 in bracket 80 on the bottom wall 60. Pin 78 is then inserted through the holes 76, 86 in the brackets 72 and 80, respectively, to secure the bottom wall 60 in place. Pin 78 is generally made from a heat resistant steel and includes a handle 88 at one end. A wire or chain 90 is preferably attached to pin 78 and bracket 76 to tether pin 78 to the reaction container 52.

In alternative embodiments, reaction container 52 may include other suitable closure means for opening and closing the container. For example, the closure may be coupled to reaction container 52 by hinges, latches, screws or pins. The reaction container 52 in preferred embodiments is made from heat resistant steel having a diameter of about five inches and a height of about nine inches. The reaction container is generally dimensioned to receive up to about eight pounds of aluminum. The aluminum or other metal is added to the container in the granular or spherical particles. The aluminum spheres in the form of shot are preferably small enough to provide sufficient surface area to react with the nitrogen gas and to be easily dispersed in the molten zinc. The aluminum shot is initially sufficiently large to be retained in the reaction container until melted by the molten zinc. The aluminum is generally about 99.5% pure.

The method of the invention is able to clean the walls of the kettle and add the aluminum to the molten zinc. Prior to cleaning the kettle walls using the device shown in FIGS. 1–6, the kettle walls near the zinc surface must be thoroughly cleaned manually. The scale which builds up on the wall of the kettle is generally a mixture of ash, flux and floating dross. This scale is removed using a pick axe or other suitable mechanical means such as cutting or prying. After the bulk of the scale is removed, the kettle walls are cleaned using the device shown in FIG. 1. In preferred embodiments, the kettle walls are cleaned using a smaller version of the reaction container shown in FIG. 1 such that the device can be hand held and controlled without the use of heavy equipment. Typically, the smaller version of the reaction container does not include the support structure or the horizontal supply pipe 12 such that the nitrogen supply is coupled directly to the vertical feed pipe 14.

In embodiments of the invention, the kettle walls can be cleaned using an air hammer. Typically, an air hammer is used when the zinc level in the kettle is about 1 to 2 inches lower than normal operating levels. The air hammer is used to remove the bulk of the scale on the walls of the kettle. Once the bulk of the scale is removed, a cleaning knife is used to scrape the remaining scale from the walls of the kettle. The cleaning knife is preferably a hollow steel pipe forming a wand having small openings in the end for dispensing nitrogen into the molten zinc. A chisel or knife blade is attached to the end of the wand adjacent the openings. In embodiments of the invention, the knife extends radially outward from the wand and includes a sharpened edge on one or both edges of the knife. The knife edge is used to scrape the scale while injecting nitrogen into the zinc.

After cleaning the kettle wall with the knife, a wand without a knife blade is used to inject or disperse nitrogen into the molten zinc. Preferably, nitrogen is injected at a rate of about 30 cu. ft/hour (15 l/min) for about five minutes in a typical 25 foot long galvanizing kettle. The wand is positioned with the nitrogen outlet against the kettle wall and about one inch below the surface of the molten zinc. The wand is then immersed about six inches below the molten zinc surface for a period of time. Finally, the wand is immersed about 18 inches below the molten zinc surface and next to the wall. The nitrogen is injected until little or no black smoke or dust comes off.

After the kettle is completely cleaned, the kettle walls can be cleaned daily using the knife. The depleted aluminum is replenished using the reaction container positioned against the walls. It is preferred to add the aluminum by placing the reaction container about 12–18 inches from the bottom of the kettle to prevent the dross on the bottom of the kettle from being disturbed. Similarly, when the zinc feedstock is added to the kettle, it is desirable to add the zinc near the bottom. Adding feedstock zinc to the top of the molten zinc can cause the solid zinc to fall or sink quickly to the bottom, thereby stirring up the dross.

In preferred embodiments, about one pound of pure aluminum is placed in the reaction container 52 via the closure 64 or removable bottom wall 60. The reaction container 52 is immersed in the molten zinc and the nitrogen is supplied through feed pipe 14 to the reaction container 52 through holes 104 in the lower end of feed pipe 14 to form a plurality of discrete nitrogen bubbles 106 in the molten zinc as shown in FIG. 2. The nitrogen bubbles 106 move upwardly through the molten zinc in the reaction container to contact the aluminum 108 in the reaction container 52. The aluminum 108 being less dense than the molten zinc rises toward the upper end of the reaction container 52 as shown in FIG. 2. The reaction container 52 is then moved against the kettle wall 110 about six inches below the surface of the molten zinc 112 as shown in FIG. 1. The reaction container is moved around the edges of the kettle to clean the walls 110 of the kettle. During the nitrogen injection, orange sparkling embers, black liquid, black smoke and dust and the smell of burned black gunpowder rise to the surface of the molten zinc. The kettle walls 110 are clean when the sparkling embers, black material and the smell of burnt black gunpowder cease to rise from the zinc surface.

The amount of nitrogen injected into the molten zinc depends on several factors including the temperature of the molten zinc, the impurities in the zinc and the amount of scale on the kettle walls. In preferred embodiments, the nitrogen is injected at a rate of about 15 cubic feet per hour for 10 minutes during each 24 hour work day regardless of galvanizing production. Typically, the production in a commercial galvanizing process is between 20,000 and 600,000 pounds per day.

The amount of aluminum added to the reaction container also depends on various factors. Preferably, the amount of aluminum added ranges from about ¼ pound to about 5 pounds for each 100,000 pounds of steel to be galvanized. Generally, it is desirable to use smaller amounts of aluminum initially and increase the amount of aluminum as needed to obtain the desired zinc coating. For example, a galvanizing facility which exhibits only minimal amounts of white rust on the galvanized finish can initially start with about two pounds of aluminum per 100,000 pounds of steel to be galvanized in a 24 hour period. The amount of nitrogen and aluminum added does not depend on the size of the galvanizing kettle. The amounts in the disclosed embodiments are for use in a conventional sized galvanizing kettle. A conventional galvanizing kettle is defined as being about 6 to 70 ft. long, 3 to 8 ft. wide and 3 to 9 ft. deep. The temperature of the zinc is generally maintained at about 845° C and is monitored by type J thermocouples.

In alternative embodiments, the kettle walls can be cleaned using a modified nitrogen injecting device comprising a nitrogen feed pipe having a plurality of gas outlets at the lower end. The modified injecting device is similar to the feed pipe 14 without the reaction container shown in FIG. 1. The feed pipe is preferably a ½ inch diameter pipe having 10 1/16 inch diameter holes at the lower end. The feed pipe is positioned against the kettle wall about six inches below the surface of the zinc and moved around the outer edge of the kettle to clean the scale from the wall of the kettle. However, the use of nitrogen alone without the addition of aluminum rapidly depletes the aluminum from the zinc which must be replaced before the workpieces are galvanized.

After the kettle walls are cleaned, the molten zinc is treated by injecting nitrogen and introducing aluminum to form a zinc-aluminum alloy. About two pounds of aluminum are added to the molten zinc in a kettle scheduled to galvanize about 100,000 pounds of steel in the subsequent 24 hour period. This amount of aluminum when added to a standard size galvanizing kettle will produce a zinc alloy having about 0.001 wt % aluminum. This is a process in which a dynamic equilibrium is established. That is, a small kettle will reach 0.001% aluminum quite quickly, whereas a larger kettle will take longer. The aluminum 108 is placed in the reaction container 52 through the closure opening 66 or through the removable bottom wall 60. The reaction container 52 is then closed and the nitrogen pressure is adjusted to about 25 to 70 psi. The nitrogen flow valve is adjusted to supply the nitrogen at a rate of about 15 cubic feet per hour. The reaction container 52 is then lowered into the molten zinc to position the reaction container 52 about one foot above the bottom of the dross in the kettle. The nitrogen flow is adjusted as necessary to maintain a flow of about 15 cubic feet per hour. The depth of the reaction container 52 in the molten zinc is monitored by the depth indicator 56. After the reaction container 52 is positioned at the proper depth in the molten zinc, the container 52 is pushed against the sidewall 110 of the kettle and slowly taken around the inside perimeter of the kettle against the kettle wall 110. In preferred embodiments, the reaction container 52 is moved about two or three revolutions around the perimeter of the kettle while the nitrogen is injected for 10 minutes. At the end of 10 minutes, the reaction container 52 is withdrawn from the molten zinc 112. The reaction container 52 and feed pipe 14 are cleared of molten zinc and debris by continuing the flow of nitrogen during withdrawal. This process step is carried out once each 24 hours and eliminates the need for additional aluminum or alloy bars to be added to the molten zinc. After one to five working days, the aluminum content will be about 0.001% and will produce an excellent quality galvanized finish.

When the reaction container 52 is immersed in the molten zinc, the nitrogen exits the feed pipe 14 through the outlets 104 to form discrete nitrogen bubbles 106 within the reaction container as shown in FIGS. 2 and 3. The nitrogen bubbles 106 rise upwardly and contact the aluminum 108 contained within the reaction container 52. At least a portion of the nitrogen reacts with the aluminum to form aluminum nitride which is dispersed into the molten zinc. The remainder of the aluminum is dispersed into the molten zinc to form a zinc aluminum alloy. The unreacted nitrogen exits the reaction container through the holes in the sidewall and bubble upwardly through the molten zinc to the surface.

In galvanizing facilities having a zinc kettle with a monorail hoist lengthwise down the center of the kettle, the horizontal pipe 12 can be pushed downward by a worker to force the reaction container 52 against the opposite sidewall of the kettle. Similarly, the horizontal pipe 12 can be lifted by the worker to force the reaction container 52 against the kettle wall nearest the worker. The two holes 28 in the hoist lifting plate 26 serve as a pivot point as the worker pushes downward or upward on the horizontal pipe 12 to position the reaction container 52 against the desired kettle wall. The two hoist lifting holes 28 prevent the lifting plate 26 and vertical feed pipe 14 from pivoting along the longitudinal axis of the zinc kettle and out of control. In embodiments where the zinc kettle includes a bridge crane, the horizontal supply pipe 12 is used to control the nitrogen supply hose 20 and prevent the hose from being burned by the molten zinc. When the zinc kettle is surrounded by a smoke exhausting enclosure, the horizontal pipe 12 must be short enough to fit inside the enclosure. In further embodiments, a hooked rod can also be used to pull or push the vertical pipe 16 against the kettle walls.

The amount of aluminum added to the molten zinc via the reaction container is determined according to the desire amount of aluminum in the zinc-aluminum alloy and, thus, accounts for the loss of aluminum by the processing steps. At least a portion of the aluminum will be lost in the skimmings which must be taken into consideration in calculating the aluminum addition.

The desired aluminum content of the resulting zinc alloy is based on the dynamic equilibrium of the alloy. As used herein, the dynamic equilibrium of the aluminum-zinc alloy is the point at which the composition remains essentially constant during the galvanizing process. The dynamic equilibrium is attained when the aluminum is no longer being depleted in large amounts in the ash.

It has been found that 1 ½ pounds of aluminum added to about 500,000 pounds of zinc for coating about 100,000 pounds of steel immediately produced a bright finish using the process of the invention. The resulting coating obtained initially still had some pimple-like imperfections in the surface. However, with daily addition of aluminum in the manner disclosed herein, after about 1 to 3 weeks, the pimple-like imperfections disappeared. Continued daily addition of aluminum continuously improved the quality of the zinc coatings. In about 1–6 months, the zinc coatings became thinner and improved in quality.

Although not intending to be bound by any particular theory of the invention, it is believed that by using the process and apparatus described herein, the nitrogen intimately contacts the aluminum and reacts to form aluminum nitride. The aluminum nitride in combination with the alloyed aluminum is believed to produce the high quality finish. Although aluminum nitride is formed in small amounts, its presence is believed to promote the formation of the high quality coating. The addition of the nitrogen may also remove impurities from the molten zinc, displace the oxygen at the surface of the molten zinc to reduce oxide formation, and to uniformly disperse the aluminum in the zinc.

In a further embodiment of the invention, vegetable matter may be added to the molten zinc to remove some of the impurities present. Examples of suitable vegetable matter includes raw potatoes and green fresh-cut wood.

In an alternative embodiment shown in FIG. 7, the reaction container 52' includes a divider 114 to divide the container into an upper compartment 118 and lower compartment 120. The divider 114 preferably includes a plurality of holes 116 to allow the nitrogen or other gas to flow from one compartment to another. The reaction container 52' is otherwise identical to the container of FIG. 2 and, thus, like components are designated by the same reference numbers with the addition of a prime. In the embodiment illustrated, the compartments are able to receive different alloying metals so that the two metals can be simultaneously added to the molten zinc. In use, the container 52' is immersed into the molten zinc and nitrogen is injected into the container through feed pipe 14'. The nitrogen exits feed pipe 14' through holes 104' and bubbles upwardly through the bed of the first metal 122, through holes 116 in divider 114 and through the bed of the second metal 124. The molten zinc enters through holes 56' in the sidewall 54' to form the alloy with the metals 122 and 124.

In further embodiments, the reaction container may be divided into several compartments arranged horizontally or vertically. For example, a plurality of dividers similar to the divider shown in FIG. 7 may be arranged vertically to define several compartments. Each divider may have different size holes decreasing in size from the lowermost to the uppermost divider. In this manner, as the size of the aluminum particles decrease, they will pass through each divider so that each compartment contains different size particles of aluminum until the aluminum is completely dispersed in the zinc. Alternatively, the aluminum can be initially placed in each compartment to enhance nitrogen-aluminum contact as the nitrogen passes from one compartment to another.

The process of the invention is effective in cleaning the walls of the zinc kettle and reducing the amount of dry ash formed on the surface of the zinc thereby reducing the aluminum and zinc consumption compared to the previous galvanizing processes. The process uses comparatively small amounts of nitrogen which prevents loss of aluminum and excessive ash formation on the surface of the zinc. In embodiments, the aluminum is added in an amount to maintain the aluminum concentration in the molten zinc at about 0.001%. In addition, the nitrogen is injected at a rate such that the aluminum is always in a molar excess of the amount of nitrogen injected into the molten zinc.

The amount of aluminum in the zinc will vary depending on the desired coating and article being coated. For example, some excellent quality coatings are obtained using 0.0002% aluminum. Galvanizing pipes have been found to give excellent coatings using 0.005% aluminum while sheet materials may use as much as 0.25% aluminum.

Using enthalpy and entropy data and the Gibbs-Helmholtz equation, the Gibbs free energy of −1,841 thermochemical calories is calculated for each mole of aluminum (27 grams) reacting with nitrogen at 845° F. Thus, the reaction between aluminum and nitrogen to form aluminum nitride is spontaneous and must occur at a finite rate provided sufficient energy is supplied to overcome the activation energy (Ea). The reaction between aluminum and oxygen in the air at the zinc surface under these same conditions has a Gibbs free energy value of −4,617 calories/mole of aluminum. However, aluminum oxide film forms a strong barrier and may limit the (kinetics) reaction speed for the aluminum-oxygen reaction.

These calculations show the likely formation of aluminum nitride and the requirement of using low molar amounts of nitrogen for successful results. Excess nitrogen exposes the zinc to excess oxygen at the surface resulting in the large ash formation when excess nitrogen is used as in the previous process. In the prior processes, the amount of nitrogen used is approximately 50 times the amount used in the present invention. The excess nitrogen produces about 400 pounds of wasteful dry ash each day. At current zinc prices of $0.50/pound and ash at $0.10 pound, this results in a daily loss of $160. For a 300 work-day year, this results in a loss of $48,000. The ash formation and loss of zinc are independent of production. This increased amount of ash produced by the prior processes is in addition to ash formed by normal production. In the prior processes, reducing the amount of nitrogen does not produce a sufficient amount of aluminum nitride to give good results.

Another very important feature of this invention is that nitrogen is the limiting chemical reactant, unlike prior processes where nitrogen was used in excess. A galvanizer using seven liters/minute of nitrogen at about two atmospheres pressure (absolute pressure due to normal air pressure 14.7 psi and the pressure at six feet down in molten zinc of about 15 psi) according to the ideal gas law is 5.7 moles of nitrogen (MW=28). Consuming two pounds of aluminum equates to using 33.6 moles of aluminum (MW=27). Thus, according to the reaction: $2Al+N2=2AlN$ at least 22.2 moles (1.32 pounds of aluminum) would remain after complete reaction. Since nitrogen bubbles are observed on the zinc surface, pure aluminum must remain in the molten zinc. If ½ the nitrogen (2.85 moles) reacts with the aluminum then 0.52 pounds of aluminum nitride is formed with 1.67 pounds of metallic aluminum left over. It is this accumulated aluminum nitride-alloyed aluminum metal combination that is believed to give the excellent galvanizing results.

In the prior art, excess nitrogen was used with no purposeful formation of aluminum nitride which could only occur on a hit or miss basis with the aluminum dispersed very dilutely in the zinc. In the present invention, the aluminum-nitrogen reaction is concentrated within the very small volume of the reaction can and at very high aluminum nitrogen concentrations enabling very high reaction rates.

When only one preferred embodiment of the invention has been illustrated, it will be understood by those skilled in the art that various changes and modifications can be made therein without departing from the scope of the invention as defined in the appended claims.

What is claimed is:

1. A method of cleaning and removing scale from a sidewall of a galvanizing kettle containing molten zinc, said method comprising:

immersing a gas injector into said molten zinc;

injecting nitrogen into said molten zinc through said injector below the surface of said zinc and bubbling nitrogen through said molten zinc adjacent a sidewall of said kettle, wherein at least a portion of said nitrogen contacts the wall of said kettle, thereby removing scale from said sidewall and reducing the formation of ash.

2. The method of claim 1, further comprising moving said gas injector continuously around said wall to remove scale from said sidewall.

3. The method of claim 1, comprising positioning said gas injector proximate said sidewall while injecting said gas, and injecting said nitrogen against said sidewall.

4. The method of claim 1, comprising injecting said gas at a rate of about 7 l/min.

5. The method of claim 1, comprising introducing aluminum into said molten zinc in the amount of about 0.0025% by wt or less, based on the weight of the zinc.

6. The method of claim 1, further comprising introducing aluminum into said molten zinc in the amount of at least 0.0001% by wt based on the weight of the molten zinc.

7. The method of claim 1, further comprising introducing aluminum into said molten zinc simultaneously with said nitrogen injection; and injecting said nitrogen to contact said aluminum whereby a portion of said nitrogen reacts with said aluminum to form aluminum nitride, the remainder of said nitrogen contacting said sidewall and the remainder of said aluminum forms a zinc-aluminum alloy.

8. The method of claim 7, comprising introducing said aluminum in an amount to form an alloy containing about 0.0001 wt % to 0.0025 wt % aluminum.

9. The method of claim 7, comprising introducing said aluminum into said molten zinc to form an alloy containing up to about 0.05 wt % aluminum.

10. The method of claim 7, comprising introducing said aluminum to form an alloy containing up to about 0.25 wt % aluminum.

11. The method of claim 8, comprising introducing said aluminum into said molten zinc in a molar excess of said nitrogen.

12. A method of producing a bright reflective zinc coating on a metal substrate, comprising the steps of:

providing a bath of molten zinc in a vessel;

simultaneously introducing aluminum and nitrogen gas to said molten zinc wherein at least a portion of said nitrogen contacts said aluminum while being introduced and forms aluminum nitride, with the remainder of said nitrogen being bubbled through said molten zinc; and immersing a metal substrate in said molten zinc to form a bright zinc coating.

13. The method of claim 1, wherein said injector comprises a reaction container having an upper wall, side wall and bottom wall and, a gas outlet in said side wall for forming discrete bubbles, and a pipe for supporting said reaction container, said method comprising fixing said reaction container in a fixed angular position and injecting said nitrogen in said molten zinc.

14. The method of claim 13, wherein said reaction container comprises an opening to receive a solid alloying metal, said method further comprising dispersing at least a portion of said alloying metal into said molten zinc.

15. The method of claim 14, wherein said reaction container includes a removable bottom wall, and said method comprises placing said alloying metal into said container.

16. The method of claim 13, wherein said pipe extends through said upper wall of said reaction container, and said method comprising supplying said nitrogen to said reaction container.

17. The method of claim 16, wherein said pipe includes a gas outlet disposed proximate a bottom wall of said reaction container, and said method comprising injecting said nitrogen proximate said bottom wall and into said molten zinc.

* * * * *